US008342654B2

(12) United States Patent
Kawamura

(10) Patent No.: US 8,342,654 B2
(45) Date of Patent: Jan. 1, 2013

(54) LIQUID INJECTION RECORDING HEAD

(75) Inventor: Shogo Kawamura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 379 days.

(21) Appl. No.: 12/763,952

(22) Filed: Apr. 20, 2010

(65) Prior Publication Data

US 2010/0271431 A1 Oct. 28, 2010

(30) Foreign Application Priority Data

Apr. 23, 2009 (JP) ..... 2009-105270

(51) Int. Cl.
*B41J 2/14* (2006.01)
*B41J 2/16* (2006.01)

(52) U.S. Cl. ..... 347/50

(58) Field of Classification Search ..... 347/50
See application file for complete search history.

(56) References Cited

U.S. PATENT DOCUMENTS 6,241,340 B1 * 6/2001 Watanabe et al. ..... 347/50
6,609,782 B2 * 8/2003 Mori ..... 347/50

FOREIGN PATENT DOCUMENTS

JP 8-332729 12/1996
JP 3592208 11/2004

* cited by examiner

*Primary Examiner* — Matthew Luu
*Assistant Examiner* — Renee I Wilson
(74) *Attorney, Agent, or Firm* — Canon USA Inc IP Division

(57) ABSTRACT

An electric wiring board 120 of a liquid injection recording head has a base film 123 formed with an opening, a first wiring member 122 formed on a first surface that is a rear surface of the base film 123 as seen from a supporting member 140, a second wiring member 129 formed at a position closer to the opening than the first wiring member 122 on the first surface, and connected to a wire 170, a cover film 124 which covers the first wiring member 122 and has an end 150 between the first wiring member 122 and the second wiring member 129, an adhesive 127 which bonds together the first wiring member 122 and the cover film 124, a third wiring member 125 formed on a second surface opposite to the first surface of the base film 123, a first through hole 160, and a second through hole 161.

4 Claims, 5 Drawing Sheets

LIQUID INJECTION RECORDING HEAD

BACKGROUND OF THE INVENTION

1. Field of the Invention

The present invention relates to a liquid injection recording head mounted on a liquid injection recording apparatus which performs a recording operation by the discharge of liquid droplets.

2. Description of the Related Art

A liquid injection recording apparatus is a so-called non-impact recording type recording apparatus, and is mounted with a liquid injection recording head which discharges liquid droplets.

FIGS. 9A and 9B are views for describing the structure of essential parts of a general liquid injection recording head. FIG. 9A is a plan view illustrating the structure of essential parts of a general liquid injection recording head 1000, and FIG. 9B is a sectional view taken along a section line 9B-9B illustrated in FIG. 9A.

In the liquid injection recording head 1000, as illustrated in FIG. 9B, a recording element substrate 1100 and an electric wiring board 1200 which are electrically connected to each other via a wire 1700 are attached to a supporting member 1400. In the electric wiring board 1200, as illustrated in FIG. 9B, a wiring member 1202 is formed on the front surface of a base film 1203. A coated region which has adhesive 1207 applied thereon and is covered with the cover film 1204, and an exposed region which is not covered with the cover film 1204 exist on the front surface of the wiring member 1202. The wire 1700 is connected to a portion of the exposed region. An electrical connection between the recording element substrate 1100 and the wire 1700 and an electrical connection between the electric wiring board 1200 and the wire 1700 are sealed using sealant 1300 and sealant 1301.

A liquid injection recording head aiming at preventing outflow of the sealant is suggested in the liquid injection recording head which has the above structure, and is disclosed in Japanese Patent Application Laid-Open No. H08-332729, and Japanese Patent No. 3592208, respectively. Japanese Patent Application Laid-Open No. H08-332729 discloses a liquid injection recording head which has the structure utilizing the thickness of the cover film as a wall which prevents the outflow of the sealant. Meanwhile, Japanese Patent No. 3592208 discloses a liquid injection recording head which uses low-viscosity sealant as sealant 1301 and uses high-viscosity sealant as sealant 1300. According to the liquid injection recording head disclosed in Japanese Patent No. 3592208, since the high-viscosity sealant is used for a sealed region where the spread of the sealant should be suppressed, the outflow of the sealant can be prevented.

In the liquid injection recording head 1000, adhesive 1207 is uniformly applied to the above-described coated region. However, a region where wiring 1202 is formed, and a region where no wiring is formed exist in the coated region. The region where the wiring 1202 is formed is thicker by the thickness of the wiring than the region where no wiring is formed. Therefore, in the manufacturing process of the cover film 1204, the adhesive 1207 applied to the region where the wiring 1202 is formed is extruded. As a result, the adhesive 1207 protrudes from an end 1500 in the region where the wiring 1202 is formed more than in the region in which no wiring is formed (refer to FIG. 9A). Specifically, a length L2 by which the adhesive 1207 protrudes from the end 1500 may be set to about 0.1 to 0.2 mm. Additionally, although a region L6 should be secured in the wiring member 1202 in order to connect the wire 1700 to the above-described exposed region, it is necessary to increase the plane area of the exposed region as the length L2 becomes long (refer to FIG. 9B). This will increase the region of an electric connection part, and as a result, will enlarge the liquid injection recording head.

In recent years, in the liquid injection recording head, the density of the wiring of the electric wiring board becomes high according to the miniaturization and increasing density of the recording element substrate. However, in the case of the liquid injection recording head 1000, when the density of the wiring become high, the percentage by which the sealed region is occupied by the wiring member 1202 will increase. Hence, due to the above-described reason, the electric wiring board 1200 tends to be enlarged according to the miniaturization and increasing density of the recording element substrate.

SUMMARY OF THE INVENTION

Accordingly, the present invention aims at providing a liquid injection recording head capable of being miniaturized.

The liquid injection recording head according to the present invention for achieving the above object includes a recording element substrate including a discharge port through which a liquid droplet is discharged, and an electrode which receives a driving signal which controls the discharge of a liquid droplet from the discharge port; an electric wiring board which supplies the driving signal to the electrode and has an opening which allows the recording element substrate to be exposed therethrough; a supporting member which supports the recording element substrate and the electric wiring board; a wire located between the recording element substrate and the electric wiring board to transmit the driving signal from the electric wiring board to the electrode; and sealant which seals an electrical connection between the electrode and the wire and an electrical connection between the electric wiring board and the wire.

Here, the electric wiring board has a base film formed with the opening, a first wiring member formed on a first surface that is a rear surface of the base film as seen from the supporting member, a second wiring member formed at a position closer to the opening than the first wiring member on the first surface of the base film, and connected to the wire, a cover film which covers the first wiring member and has an end between the first wiring member and the second wiring member, an adhesive which bonds together the first wiring member and the cover film, a third wiring member formed on a second surface opposite to the first surface of the base film, a first through hole which electrically connects the first wiring member and the third wiring member, and a second through hole which electrically connects the second wiring member and the third wiring member.

According to the present invention, since the plane area of the wiring member covered with the cover film becomes smaller than before, the amount by which the adhesive protrudes from the end of the cover film can be suppressed. This enables the liquid injection recording head to be miniaturized.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereinafter, embodiments of a liquid injection recording head of the present invention will be described with reference to the drawings. In addition, the liquid injection recording head of the present invention can be carried in a printer, a word processor, a facsimile, and a liquid injection recording apparatus represented by a copying machine.

Figure 1:
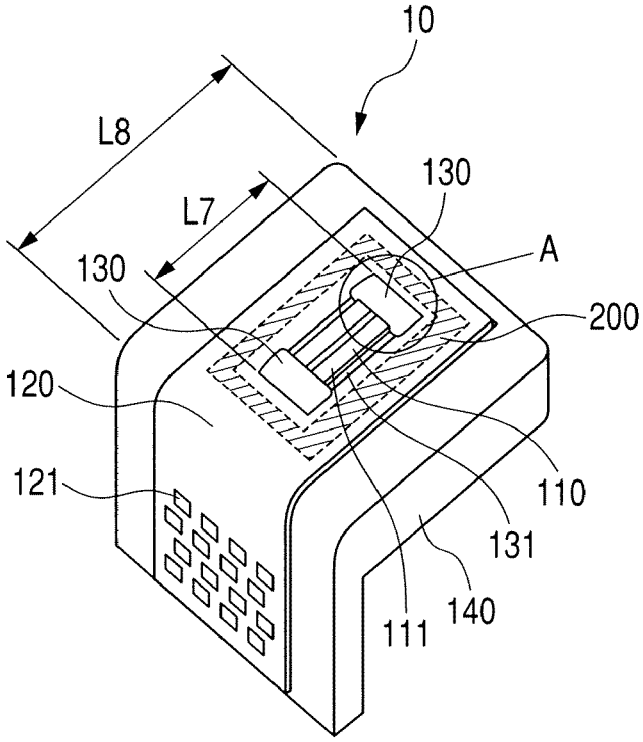
FIG. 1 is a perspective view illustrating the configuration of essential parts of a liquid injection recording head of Embodiment 1.
Figure 2:
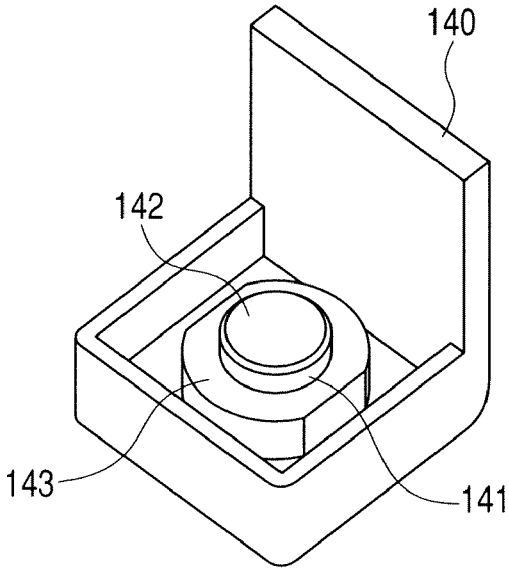
FIG. 2 is the perspective view when the liquid injection recording head illustrated in FIG. 1 is seen from the opposite side.
Figure 3A:
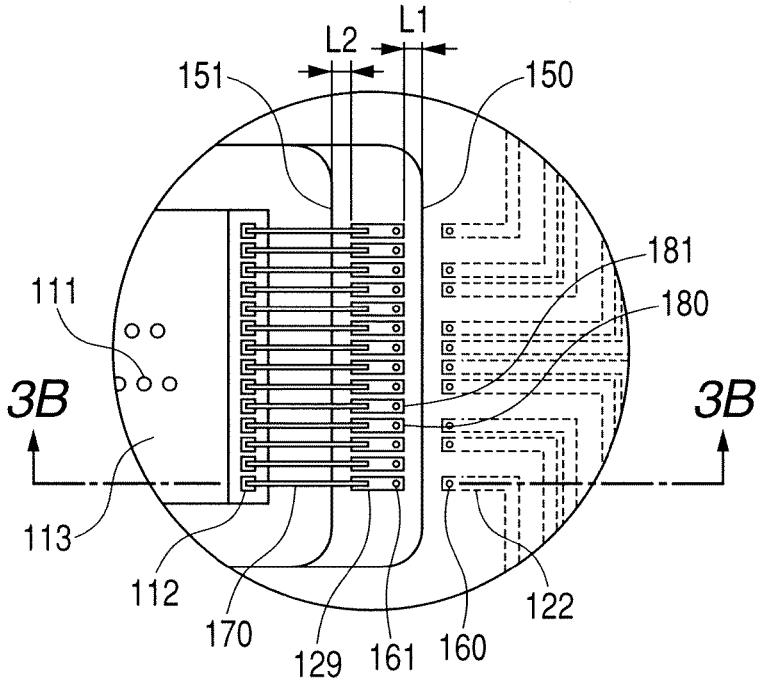
FIGS. 3A and 3B are views for describing the structure of the liquid injection recording head of Embodiment 1.
Figure 3B:
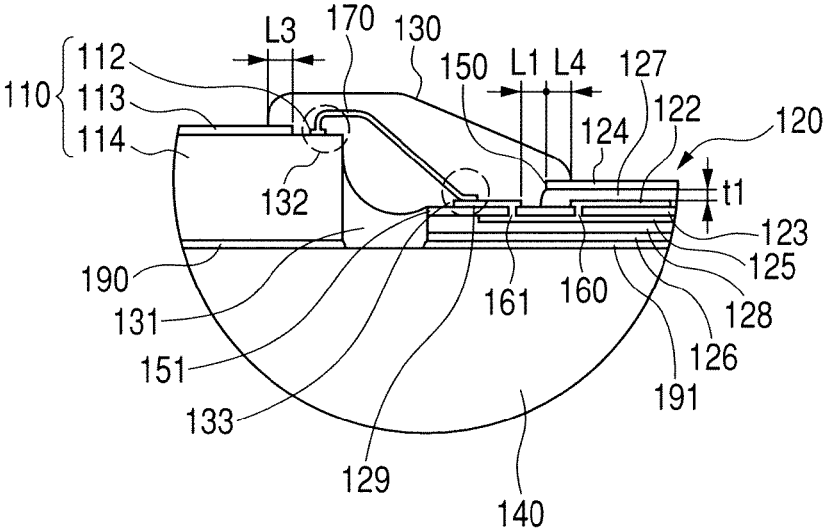

FIG. 1 is a perspective view illustrating the configuration of essential parts of a liquid injection recording head of Embodiment 1. FIG. 2 is the perspective view when the liquid injection recording head illustrated in FIG. 1 is seen from the opposite side. Additionally, FIGS. 3A and 3B are views for describing the structure of the liquid injection recording head of Embodiment 1. FIG. 3A is an enlarged view of a region A illustrated in FIG. 1. In addition, FIG. 3A illustrates a state where a portion covered with sealant is seen through for the purpose of description. Additionally, FIG. 3B is a sectional view taken along a section line 3B-3B illustrated in FIG. 3A.

In the liquid injection recording head 10 of the present embodiment, a recording element substrate 110 and an electric wiring board 120 which are electrically connected to each other via a wire 170 are attached to a supporting member 140 (refer to FIGS. 1, 3A, and 3B). In the recording element substrate 110, when a driving signal which controls the discharge of ink droplets (liquid droplets) is received by an electrode 112, an electricity-heat transducing element (not illustrated) which has a heating resistor heats ink. This allows the ink droplets to be discharged from a discharge port 111 by the action of film boiling. The electric wiring board 120 supplies the driving signal input through a contact portion 121 from a main body (not illustrated) of the liquid injection recording apparatus to an electrode 112. An electrical connection 132 between the electrode 112 and the wire 170 and an electrical connection 133 between the electric wiring board 120 and the wire 170 are sealed using sealant 130 and sealant 131. The supporting member 140 has a filter 142 and sealing rubber 143 at an ink filling port 141, and is formed with a flow path through which the ink supplied from an ink tank (not illustrated) is introduced into the recording element substrate 1100 (refer to FIG. 2). Hereinafter, the structure of the recording element substrate 110 and the electric wiring board 120 will be described in detail.

As illustrated in FIGS. 3A and 3B, the recording element substrate 110 has a heater board 114 in which an electric circuit is provided on the front surface of a silicon chip, and an orifice plate 113 in which a discharge port 111 is formed from a resin material by photolithography. A plurality of gold-plated electrodes 112 is arrayed on the heater board 114. Additionally, the heater board 114 is fixed to the supporting member 140 with an adhesive 190. The adhesive 190 is a UV-curable and thermosetting adhesive which is cured if the adhesive are irradiated with ultraviolet rays or if heat is applied, and an adhesive with chemical resistance against ink is used.

The electric wiring board 120 is a multilayered FPC board (flexible printed circuit board) of at least two layers. In the present embodiment, an FPC board of two layers is used as the electric wiring board 120. One layer in this electric wiring board 120, as illustrated in FIG. 3B, includes a base film 123 which is formed with an opening through which recording elements 110 are exposed. The base film 123 includes a film made of polyimide with a thickness of 0.025 to 0.050 mm. Wiring made of copper with a thickness of 0.01 to 0.02 mm is formed on both faces of the base film 123.

A first wiring member 122 and a second wiring member 129 are formed at positions apart from each other on the rear surface of the base film 123 as seen from the supporting member 140, i.e., the front surface (first surface) of the base film 123. The second wiring member 129 has a plane area required as the electrical connection 132, and is formed at a position closer to the opening of the base film 123 than the first wiring member 122. Specifically, the second wiring member 129 is gold-plated with a width of about 0.1 to 0.2 mm. The first wiring member 122 is covered with the cover film 124, using an adhesive 127. The cover film 124 is a film made of aramid resin with a thickness of 0.004 to 0.050 mm or polyimide with a thickness of about 0.01 to 0.05 mm. The thickness t1 of the adhesive 127 is about 0.02 to 0.05 mm. An end 150 of the cover film 124, as illustrated in FIG. 3B, is between the first wiring member 122 and the second wiring member 129. That is, since the plane area of the wiring member occupied in a region (a region where the adhesive 127 is applied) covered with the cover film 124 decreases more than ever before, the amount by which the adhesive 127 protrudes from the end 150 of the cover film 124 decreases more than ever before. In the present embodiment, the length of the adhesive 127 protruding from the end 150 is suppressed to about 0.03 to 0.05 mm. Additionally, the second wiring member 129 is arranged such that the spacing L1 from the end 150 is set to 0.2 mm or more, and is formed at a position where the second wiring member does not come into contact with the adhesive 127.

Meanwhile, a third wiring member 125 is formed on the rear surface (second surface) of the base film 123. The third wiring member 125 is connected to the first wiring member 122 via a first through hole 160, and is connected to the second wiring member 129 via a second through hole 161. The diameter of each through hole is preferably about 0.05 mm. Additionally, the third wiring member 125 is covered with a cover film 126. The third wiring member 125 and the cover film 126 are bonded with the adhesive 128. Additionally, the cover film 126 is fixed to the supporting member 140 with an adhesive 191. The adhesive 191 is a UV-curable and thermosetting adhesive which is cured if the adhesive is irradiated with ultraviolet rays or if heat is applied, and an adhesive with chemical resistance against ink is used.

For example, wiring 180, wiring 181, etc. are provided in the liquid injection recording head 10 as wiring connected to the contact portion 121. The wiring 180 is wiring connected to the second wiring member 129 via the first through hole 160, the third wiring member 125, and the second through hole 161 from the first wiring member 122. The wiring 181 is wiring connected to the second wiring member 129 via the second through hole 161 from the third wiring member 125. Both the wiring 180 and the wiring 181 are ultimately connected to the second wiring member 129 via the second through hole 161.

The wire 170 is a wire made of gold, and is connected to the electrode 112 and the second wiring member 129, respectively, by bonding after the recording element substrate 110 and the electric wiring board 120 are fixed to the supporting member 140 (refer to FIG. 3B). This enables a signal to be transmitted to the recording element substrate 110 from the electric wiring board 120.

Thereafter, the void provided between the electric wiring board 120 and the recording element substrate 110 is filled with the low-viscosity sealant 131, and the electrical connection 132 is covered with the high-viscosity sealant 130. The sealant 130 is overlapped and applied by a dimension L3 on the orifice plate 113 formed from a resin material, and is overlapped and applied on the cover film 124 by a dimension L4. For example, both the dimension L3 and the dimension L4 are preferably about 0.1 to 0.5 mm.

In the present embodiment, the amount by which the adhesive 127 protrudes from the end 150 of the cover film 124 decreases more than ever before. This increases the percentage of the effective region (the bonding area between the sealant 130 and the base film 123) in the sealed region by the sealant 130. Therefore, the sealed region can be made small. That is, the spacing L1 (refer to FIGS. 3A and 3B) can be made small. If the spacing L1 becomes small, the distance L7 (refer to FIG. 1) illustrating the distance between the sealants can be shortened. If the distance L7 becomes short, a cap region 200 (refer to FIG. 1) where a rubber cap for preventing ink from evaporating from the discharge port 111 is brought into contact can be made small. If the cap region 200 becomes small, a head size L8 (refer to FIG. 1) can be made small. Accordingly, a miniaturized liquid injection recording head can be provided.

Figure 4:
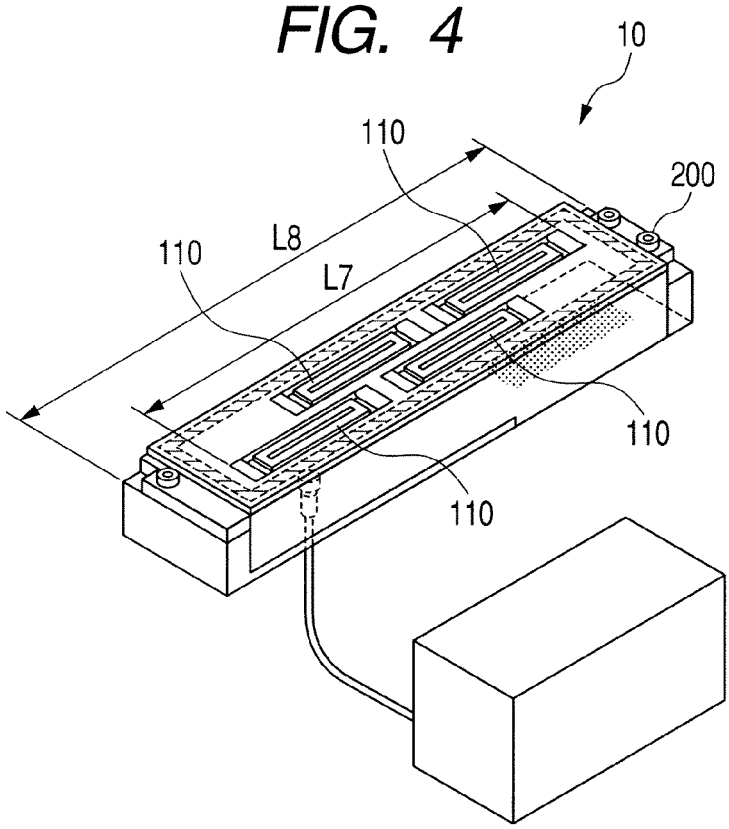
FIG. 4 is a perspective view illustrating one embodiment of a liquid injection recording head provided with four recording element substrates.

FIG. 4 is a perspective view illustrating one embodiment of a recording head 100 provided with four recording element substrates 110. Even in this case, as illustrated in FIG. 4, it is possible to shorten the distance L7 to make the cap region 200 small. Accordingly, the head size L8 can be made small.

Figure 5:
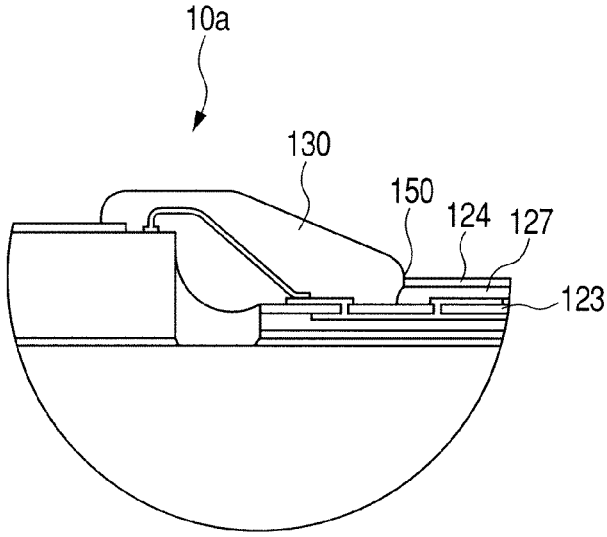
FIG. 5 is a sectional view illustrating the configuration of essential parts of a liquid injection recording head of a modification of Embodiment 1.
Figure 6:
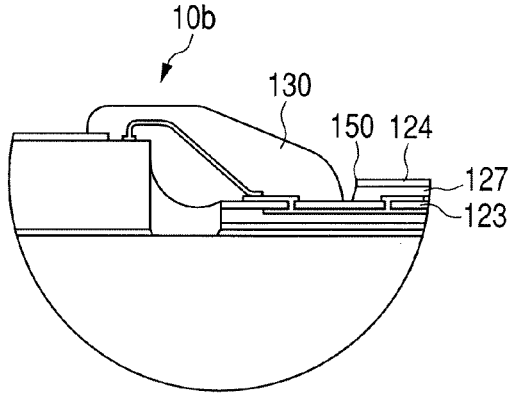
FIG. 6 is a sectional view illustrating the configuration of essential parts of the liquid injection recording head of the modification of Embodiment 1.

FIGS. 5 and 6 are sectional views illustrating the configuration of essential parts of a liquid injection recording head of a modification of Embodiment 1. FIGS. 5 and 6 illustrates cross-sections taken along a section line equivalent to a section line 3B-3B (refer to FIG. 3A) of each liquid injection recording head.

A liquid injection recording head 10*a* illustrated in FIG. 5 is in a sealed state where the sealant 130 covers the cover film 124 to the end 150 thereof. Meanwhile, a liquid injection recording head 10*b* illustrated in FIG. 6 is in a sealed state where the sealant 130 is in non-contact with the end 150 of the cover film 124. In the liquid injection recording heads 10*a* and 10*b*, an adhesive with sufficient chemical resistance against ink is used as the adhesive 127. In this case, since a bonding region between the sealant 130 and the base film 123 is sufficiently secured, even if the cover film 124 is not sealed with the sealant 130, the same effect as the liquid injection recording head 1 is exhibited. Moreover, since the liquid injection recording heads 10*a* and 10*b* can reduce a larger amount of the sealant 130 used than the liquid injection recording head 10, liquid injection recording heads with excellent economy are obtained.

Figure 7:
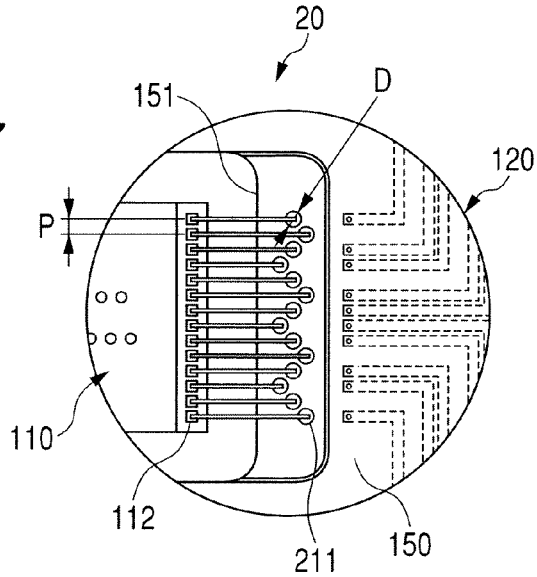
FIG. 7 is an enlarged view illustrating the configuration of the essential parts of the liquid injection recording head of Embodiment 2.

FIG. 7 is an enlarged view illustrating the configuration of the essential parts of the liquid injection recording head of Embodiment 2 of the present invention. FIG. 7 illustrates a portion equivalent to a region A (refer to FIG. 1) of a liquid injection recording head 20 of the present embodiment in an enlarged manner, and illustrates a portion covered with sealant in a see-through state. Additionally, the same components in FIG. 7 as those of the liquid injection recording head 10 described in Embodiment 1 will be denoted by the same reference numerals, and detailed description thereof will be omitted.

In a recording element substrate 110 of the liquid injection recording head 20, a plurality of electrodes 112 is arrayed along a peripheral edge 151 of a base film 123. In the electric wiring board 120 of the liquid injection recording head 20, a plurality of lands 211 which is island-like members which correspond to the plurality of electrodes 112 individually are provided as the second wiring member 129. The lands 211 are shaped so as to surround the peripheral edge of the second through hole 161. Additionally, in the electric wiring board 120, the end 150 of the cover film 124 is between the first wiring member 122 and a land 211, and the third wiring member 125 is covered with the base film 123. Since this can reduce the amount by which the adhesive 127 protrudes from the end 150 similarly to the liquid injection recording head 10, the sealed region by the sealant 130 can be made small.

In the present embodiment, the plane area of the wiring member can be made smaller than the second wiring member 129 illustrated in FIG. 3 by forming a wiring member connected to the wire 170 in the shape of a land. Since this increases the bonding area, i.e., effective sealed region between the base film 123 and the sealant 130, sealing becomes more positive. Moreover, in the present embodiment, a plurality of lands 211 is arranged in a zigzag shape in the array direction of the electrodes 112. Since this enables a plurality of lands 211 to be intensively arranged even if the diameter D of the lands 211 is greater than the pitch P of the electrodes 112, enlargement of the electric wiring board 120 can be suppressed.

Figure 8:
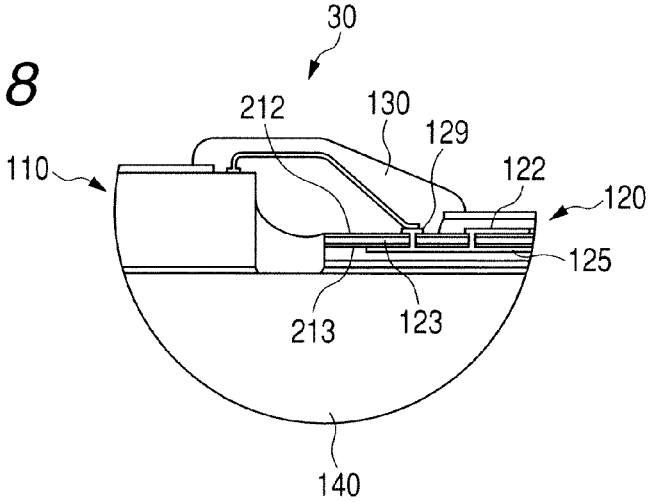
FIG. 8 is a sectional view illustrating the configuration of essential parts of a liquid injection recording head of Embodiment 3.
Figure 9A:
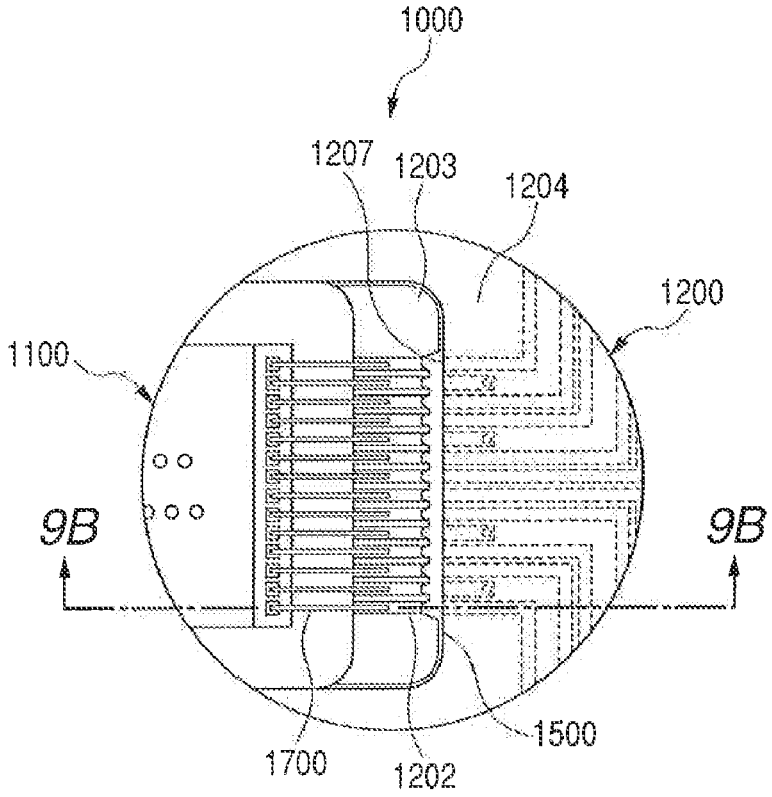
FIG. 9A (PRIOR ART)
FIGS. 9A and 9B are plan views illustrating the structure of essential parts of a general liquid injection recording head.
Figure 9B:
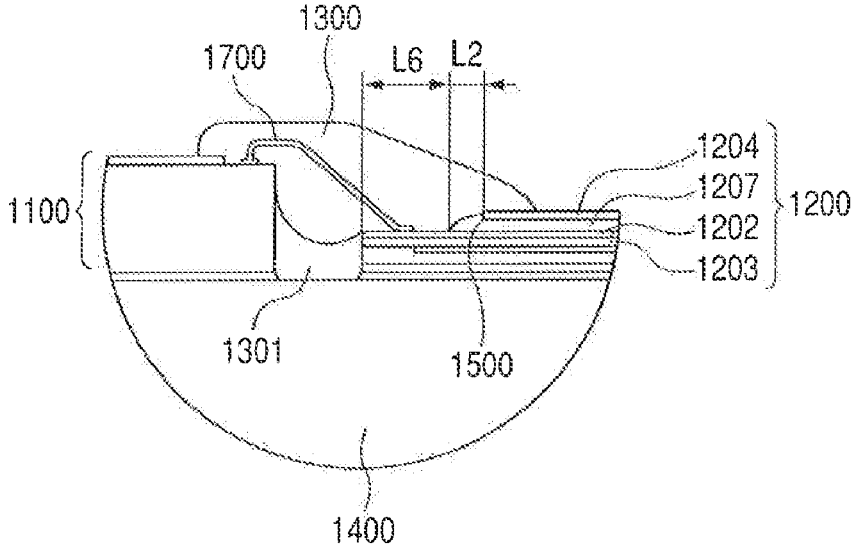
FIG. 9B (PRIOR ART)

FIG. 8 is a sectional view illustrating the configuration of the essential parts of a liquid injection recording head of Embodiment 3 of the present invention. FIG. 8 illustrates a cross-section taken along a section line equivalent to the section line 3B-3B (refer to FIG. 3A) of a liquid injection recording head 30 of the present embodiment. Additionally, the same components in FIG. 8 as those of the liquid injection recording head 10 described in Embodiment 1 will be denoted by the same reference numerals, and detailed description thereof will be omitted.

As illustrated in FIG. 8, in the electric wiring board 120 of the liquid injection recording head 30, adhesive layers 212 and 213 are respectively formed over the whole front and rear surfaces of the base film 123. The first wiring member 122 and the second wiring member 129 are pasted on the upper surface of the adhesive layer 212 formed on the front surface of the base film 123. In addition, the lands 211 described in Embodiment 2 may be pasted instead of the second wiring member 129.

According to the present embodiment, since the sealant 130 is bonded to the adhesive layer 212 formed on the base film 123, an adhesive force improves compared to a case where the sealant 130 is directly bonded to polyimide, etc. (a case where the sealant 130 and the base film 123 are directly bonded together). Hence, sealing becomes more positive.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-105270, filed Apr. 23, 2009, which is hereby incorporated by reference herein in its entirety.

What is claimed is:

1. The liquid injection recording head comprising:

a recording element substrate including a discharge port through which a liquid droplet is discharged, and an electrode which receives a driving signal which controls the discharge of a liquid droplet from the discharge port;

an electric wiring board which supplies the driving signal to the electrode and has an opening which allows the recording element substrate to be exposed therethrough;

a supporting member which supports the recording element substrate and the electric wiring board;

a wire located between the recording element substrate and the electric wiring board to transmit the driving signal from the electric wiring board to the electrode; and sealant which seals an electrical connection between the electrode and the wire and an electrical connection between the electric wiring board and the wire;

wherein the electric wiring board has a base film formed with the opening, a first wiring member formed on a first surface that is a rear surface of the base film as seen from the supporting member, a second wiring member formed at a position closer to the opening than the first wiring member on the first surface of the base film, and connected to the wire, a cover film which covers the first wiring member and has an end between the first wiring member and the second wiring member, an adhesive which bonds together the first wiring member and the cover film, a third wiring member formed on a second surface opposite to the first surface of the base film, a first through hole which electrically connects the first wiring member and the third wiring member, and a second through hole which electrically connects the second wiring member and the third wiring member.

2. The liquid injection recording head according to claim 1, wherein the second wiring member is an island-like member surrounding the peripheral edge of the second through hole.

3. The liquid injection recording head according to claim 2, wherein a plurality of the electrodes is arrayed along a portion of the peripheral edge of the opening, a plurality of the island-like members is provided corresponding to the plurality of electrodes, and the plurality of island-like members is arranged in a zigzag shape in an array direction of the electrodes.

4. The liquid injection recording head according to claim 1, wherein the adhesive and the sealant which are formed on the first surface of the base film are bonded together.

* * * * *